US006142335A

United States Patent [19]

Query, Jr.

[11] Patent Number: 6,142,335

[45] Date of Patent: Nov. 7, 2000

[54] DRINKING CUP LID WITH INTEGRAL STRAW

[76] Inventor: Henry C. Query, Jr., 504 S. Pierce Ave., Wheaton, Ill. 60187

[21] Appl. No.: 09/478,250

[22] Filed: Jan. 6, 2000

Related U.S. Application Data

[60] Provisional application No. 60/114,929, Jan. 6, 1999.

[51] Int. Cl.[7] ..... A47G 19/22

[52] U.S. Cl. ..... 220/707; 220/709

[58] Field of Search ..... 220/705, 707, 220/709, 710

[56] References Cited

U.S. PATENT DOCUMENTS

| | | | |
|---|---|---|---|
| 962,641 | 6/1910 | Kaufmann . | |
| 4,607,755 | 8/1986 | Andreozzi . | |
| 4,811,860 | 3/1989 | Sorenson et al. | 220/707 |
| 4,830,204 | 5/1989 | Lin . | |
| 4,928,876 | 5/1990 | Marshall . | |
| 5,228,603 | 7/1993 | Pham et al. . | |
| 5,409,131 | 4/1995 | Phillips et al. . | |
| 5,477,978 | 12/1995 | Lo . | |
| 5,520,304 | 5/1996 | Lin . | |
| 5,579,948 | 12/1996 | Lin | 220/707 |
| 5,702,020 | 12/1997 | Larsen | 220/709 |

*Primary Examiner*—Joseph M. Moy
*Attorney, Agent, or Firm*—Henry C. Query, Jr.

[57] ABSTRACT

A lid for a drinking cup having a bottom and a sidewall extending generally upwardly from the bottom, the sidewall including an upper edge and an inner surface, the lid comprising a base, a rim which depends from the periphery of the base and which includes a constriction for removably connecting the base to the cup over the upper edge, a mouthpiece which extends generally upwardly from the base and which has a longitudinal hole formed therethrough, an elongated stem which depends generally downwardly from the base generally opposite the mouthpiece, the stem comprising two longitudinal side surfaces which are adapted to conform to the inner surface and a longitudinal channel formed between the side surfaces, wherein the channel communicates with the hole in the mouthpiece and, when the lid is secured to the cup, the side surfaces engage the inner surface to form a fluid passageway through which fluid in the cup may be extracted.

19 Claims, 6 Drawing Sheets

Fig.1
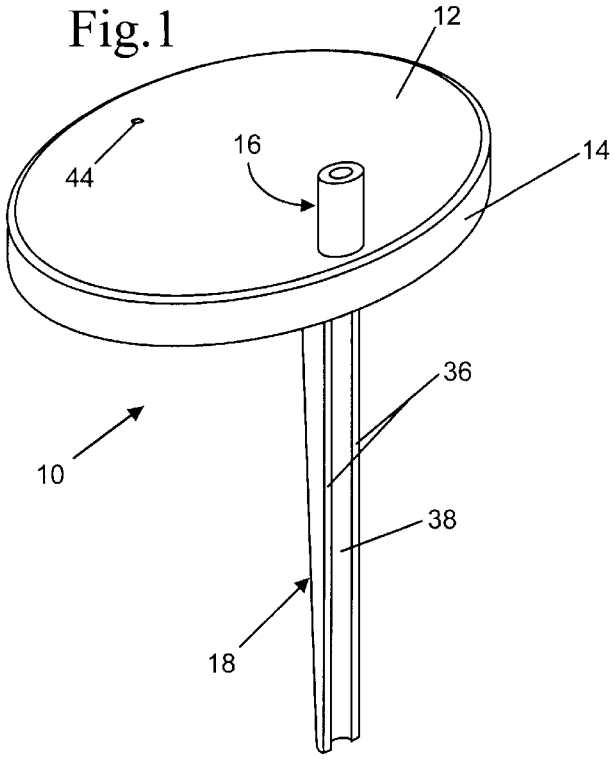
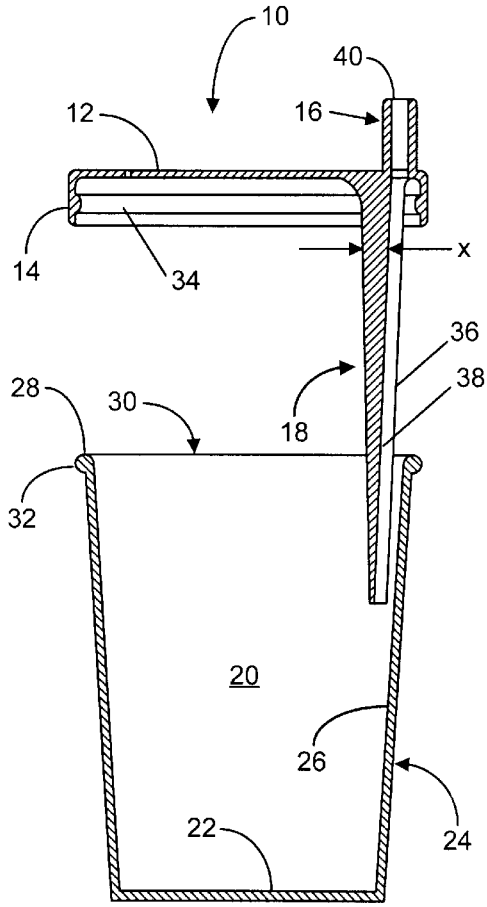
Fig. 2
Fig. 3
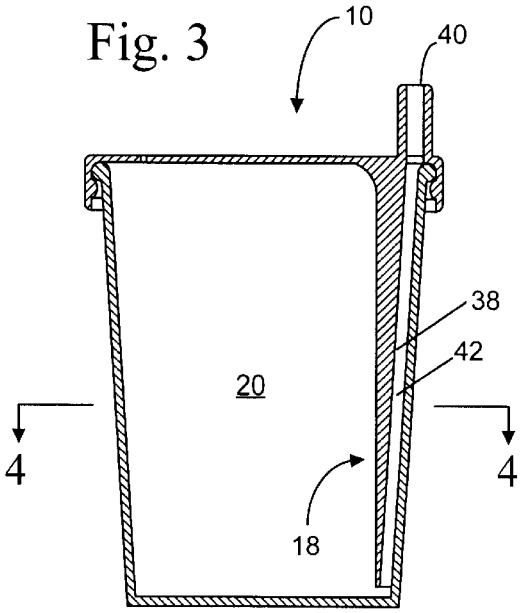

Fig. 4
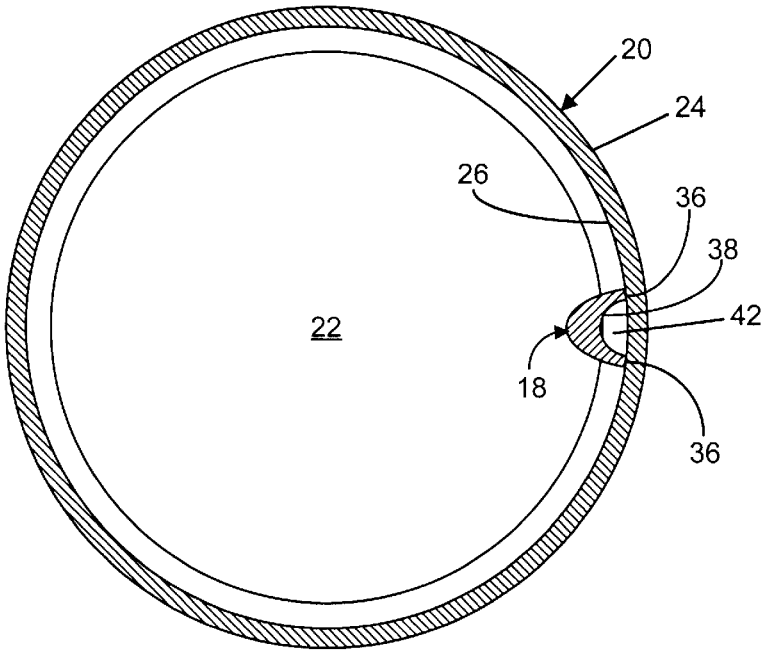
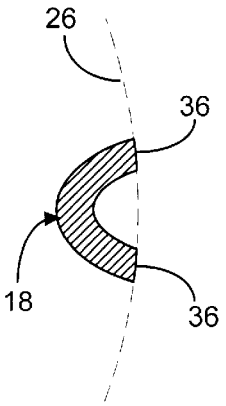
Fig. 7
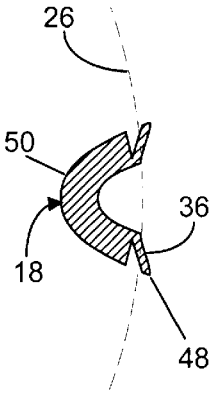
Fig. 7A
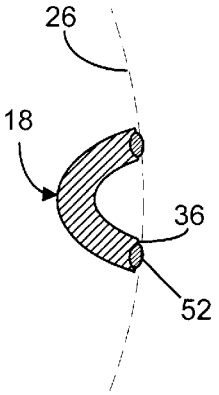
Fig. 7B
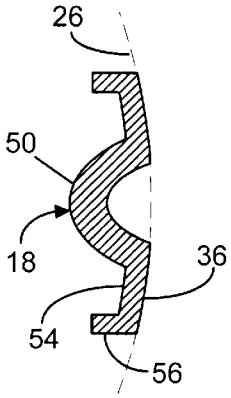
Fig. 7C Fig. 5
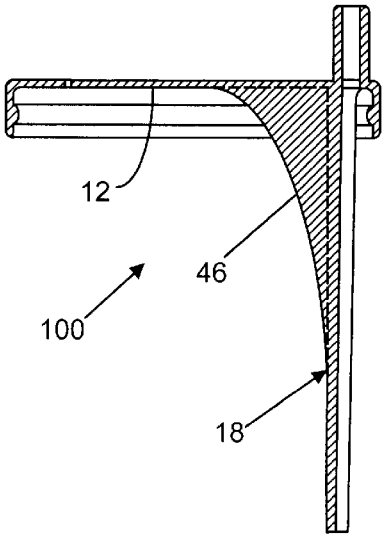
Fig. 6
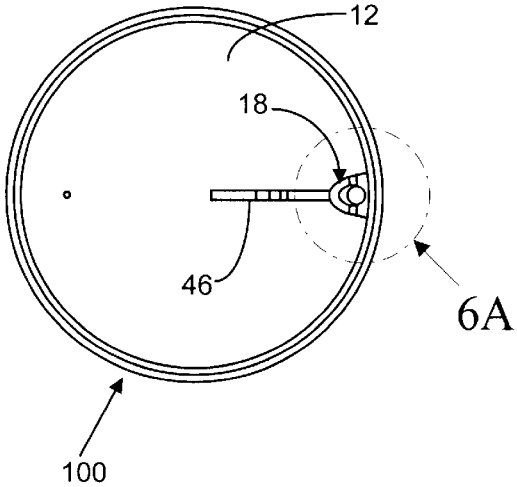
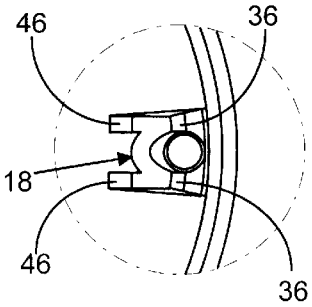
Fig. 6B
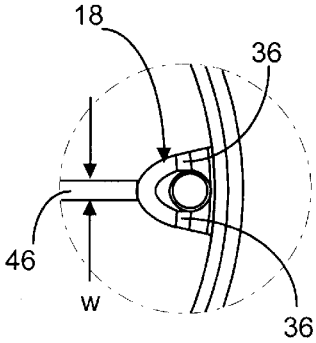
Fig. 6A

DRINKING CUP LID WITH INTEGRAL STRAW

This application is based on U.S. Provisional Patent Application Ser. No. 60/114,929 filed on Jan. 6, 1999.

BACKGROUND OF THE INVENTION

The present invention relates to lids for drinking cups. More particularly, the invention relates to a lid having a downwardly depending stem which, together with the inner surface of the cup, forms a straw through which fluid in the cup may be extracted.

Many prior art lids for drinking cups, particularly those marketed for use by children, include a straw which attaches to the bottom of the lid and a mouthpiece connected to the top of the lid opposite the straw. The mouthpiece includes a hole which communicates with the straw, and these two elements form a fluid passageway through which fluid in the cup may be extracted.

However, since these straws are elongated tubular objects, they are difficult to clean. In addition, because the straws are typically removably attached to the lid, they are subject to being misplaced.

SUMMARY OF THE INVENTION

In accordance with the present invention, these and other problems are overcome by providing a lid for a drinking cup which comprises a base, a rim which depends from the periphery of the base and which is adapted to be connected to the upper edge of the side wall of a cup, a mouthpiece which extends generally upwardly from the base and has a longitudinal hole formed therethrough, and an elongated stem which depends generally downwardly from the base generally opposite the mouthpiece. The stem comprises a generally semi-circular cross section which forms two side surfaces, which are adapted to conform to the inner surface of the side wall of the cup, and a longitudinal channel, which is formed between the side surfaces adjacent the inner surface. The channel communicates with the hole in the mouthpiece, and when the lid is secured to the cup, the side surfaces of the stem seal against the inner surface of the side wall to enable the channel to form a fluid passageway through which fluid in the cup may be extracted.

In this manner, the stem and the side wall of the cup function as a straw. However, since the channel is generally open when the lid is separated from the cup, it may be easily cleaned. Furthermore, since the stem is connected to the base of the lid, it is not subject to being misplaced.

These and other objects and advantages of the present invention will be made apparent from the following detailed description of the preferred embodiments, with reference to the accompanying drawings. In the drawings, the same reference numbers are used to identify similar elements in the various embodiments.

BRIEF DESCRIPTION OF THE DRAWINGS

FIG. 1 is a perspective view of one embodiment of the lid of the present invention;

FIG. 2 is a longitudinal cross-sectional view of the lid of FIG. 1 shown being inserted into an exemplary cup;

FIG. 3 is a longitudinal cross-sectional view of the lid of FIG. 1 shown fully assembled with the exemplary cup;

FIG. 4 is a radial cross-sectional view of the lid and cup assembly taken along line 4—4 of FIG. 3;

FIG. 5 is a longitudinal cross-sectional view of another embodiment of the lid of the present invention;

FIG. 6 is a bottom view of the lid depicted in FIG. 5;

FIG. 6A is an enlarged view of a portion of the lid illustrated in FIG. 6;

FIG. 6B is an enlarged view similar to FIG. 6A, but showing an alternative embodiment of the lid of the present invention;

FIG. 7 is an exemplary radial cross-sectional view of the stem portion of the lid of the present invention;

FIGS. 7A through 7C are radial cross-sectional views similar to FIG. 7, but showing alternative embodiments of the stem portion of the lid of the present invention;

DETAILED DESCRIPTION OF THE PREFERRED EMBODIMENTS

Figures 8, 8A:
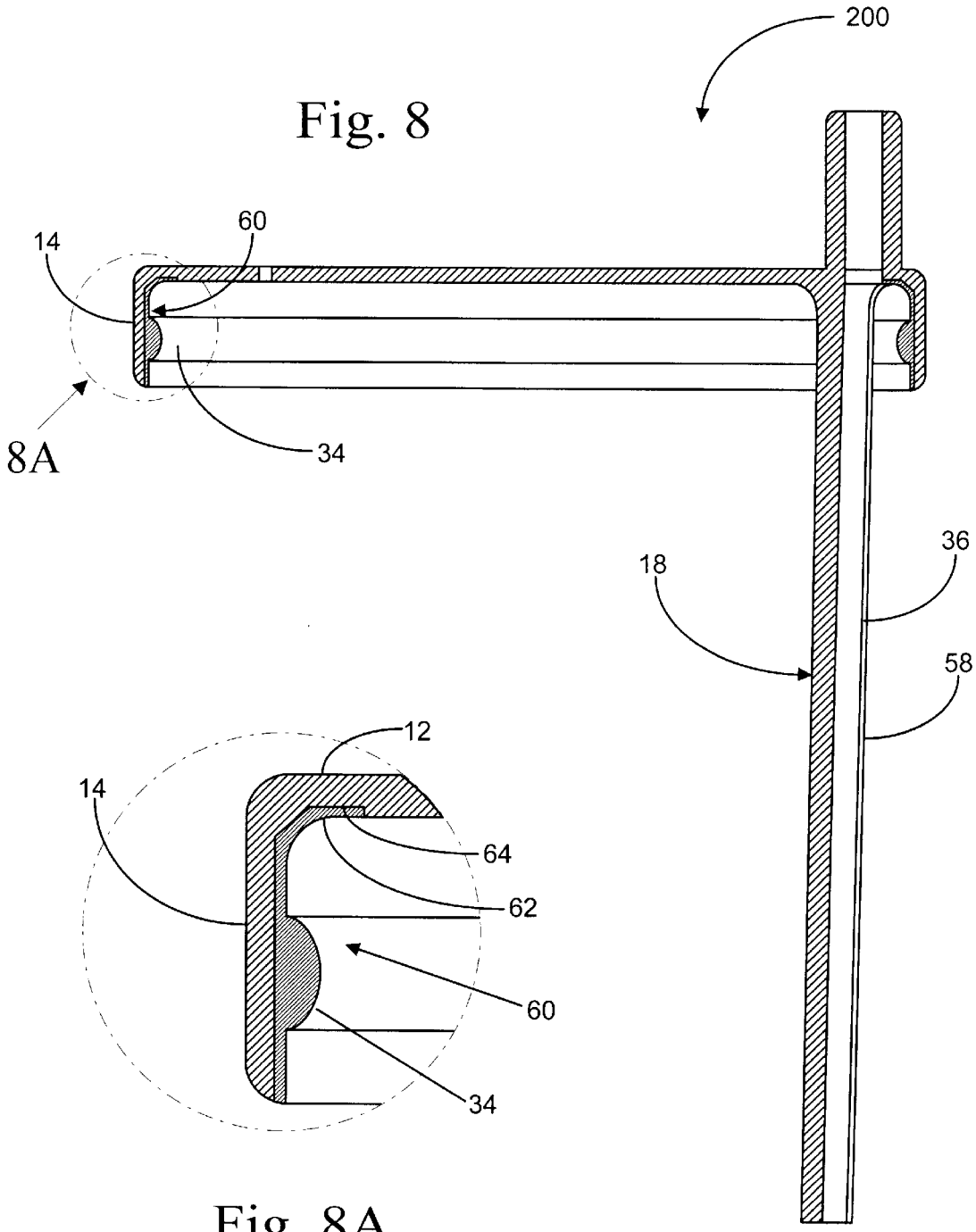
FIG. 8 is a longitudinal cross-sectional view of another embodiment of the lid of the present invention.
FIG. 8A is an enlarged view of a portion of the lid illustrated in FIG. 8.

Referring to FIG. 1, the drinking cup lid of the present invention, indicated generally by reference number 10, is shown to comprise a base 12, a rim 14 which depends downwardly from the periphery of base 12, a mouthpiece 16 which extends generally upwardly from base 12, and an elongated stem 18 which depends generally downwardly from base 12 generally opposite mouthpiece 16. The lid 10 is preferably made of a plastic material, such as Polypropylene, and is optimally manufactured as one piece in an injection molding process.

The lid 10 is adapted to be assembled with a drinking cup. Referring to FIGS. 2 and 3, an exemplary drinking cup 20 is shown to comprise a bottom 22 and an upstanding side wall 24 having an inner surface 26 and an upper edge 28 defining a mouth or opening 30 of cup 20. The exemplary cup 20 typically also comprises an annular lip 32 protruding radially outwardly from the upper edge 28. Although cup 20 is shown to be generally cylindrical, it should be understood that the lid 10 of the present invention could be used in conjunction with various shaped cups. The shape of lid 10 is generally dictated by the shape of the mouth 30 of cup 20. Thus, in the Figures the base 12 and rim 14 of lid 10 are shown to be generally circular.

Various means may be provided to secure lid 10 to cup 20. In the embodiment depicted in FIGS. 1 through 3, the rim 14 of lid 10 includes a radial constriction 34 which is adapted to engage lip 32 and thereby firmly secure the lid 10 over the mouth 30, as shown in FIG. 3. Other means to secure lid 10 to cup 20 could include cooperating threads on both rim 14 and cup 20. Any other conventional means for securing a lid to a cup could also be used to secure lid 10 to cup 20.

Referring now to FIGS. 1 through 4, stem 18 is shown to comprise a generally elliptical or semi-circular radial cross section defining a pair of side surfaces 36 which face the inner surface 26 of side wall 24 and a longitudinal channel 38 formed between the side surfaces 36. The channel 38 extends substantially the entire length of stem 18 and communicates with a hole 40 formed through mouthpiece 16 and base 12. As shown more clearly in FIG. 4, side surfaces 36 are adapted to conform to and seal against the inner surface 26 of cup 20. Side surfaces 36 and inner surface 26 preferably form an interference fit when lid 10 is attached to cup 20 so as to ensure a fluid-tight seal between stem 18 and inner surface 26 along the length of channel 38. Thus, stem 18 preferably extends at a smaller angle from vertical than side wall 24 so that side surfaces 36 will engage and be biased against inner surface 26 when lid 10 is attached to cup 20.

In this manner, when lid 10 is secured to cup 20, the side surfaces 36 and the inner surface 26 will form a fluid passageway 42 which communicates with the hole 40 in the mouthpiece 16 and through which fluid in the cup may be extracted. Thus, the stem 18 and the side wall 24 of cup 20 function as a straw. However, since channel 38 is generally open when lid 10 is separated from cup 20, channel 38 and the lid 10 in general may be easily cleaned. Furthermore, since stem 18 is connected to the base 12 of lid 10, it is not subject to being misplaced. Finally, as shown more clearly in FIG. 1, lid 10 may also comprise a vent hole 44 formed in the base 12 to allow air to enter cup 20 when fluid is being sipped through the mouthpiece 16.

The construction of lid 10 preferably permits stem 18 to flex somewhat yet maintain a relatively strong bias against side wall 24 to ensure that side surface 36 firmly and sealingly engage the inner surface 26 when lid 10 is attached to cup 20. As shown in FIGS. 2 and 3, the radial cross section of stem 18 may have a thickness "x" which tapers from the upper end of stem 18 adjacent base 12 to the bottom end of stem 18. This will enable the lower portion of stem 18 to flex upon insertion into cup 20 and the upper portion of stem 18 to remain more rigid in order to sustain the bending force created by the interference fit between stem 18 and side wall 24.

Another embodiment of the invention is illustrated in FIGS. 5 and 6. The lid of this embodiment, which is designated generally by reference number 100, is similar in many respects to the lid 10 depicted in FIGS. 1 through 4. However, in lid 100 the thickness "x" of the radial cross section of stem 18 is preferably generally constant from the top to the bottom of stem 18. In order to provide radial support for stem 18, lid 100 comprises a support rib 46 extending between stem 18 and the underside of base 12. Rib 46 permits stem 18 to flex somewhat yet maintain a relatively strong bias against side wall 24 when lid 100 is secured to cup 20. While the rib 46 is shown extending radially from stem 18 to approximately the center of base 12, the particular design of lid 100 may require rib 46 to extend more or less than shown. Similarly, although rib 46 is shown to terminate approximately midway down the longitudinal extent of stem 18, it may extend more or less, including substantially to the bottom of stem 18.

The rib 46 is preferably formed integrally with lid 100 in an injection molding process. In addition, as shown more clearly in FIG. 6A, rib 46 preferably has a width "w" approximately the same as the thickness "x" of the cross section of stem 18. Thus, when lid 100 is inserted into cup 20, the bending forces imparted on stem 18 will be transmitted from the side surfaces 36, through the semi-circular cross section of stem 18 and into rib 46. Since rib 46 is relatively rigid in the radial direction, it will maintain the side surfaces 36 of stem 18 in firm contact with the side wall 24 of cup 20.

In accordance with another embodiment of the invention, which is depicted in FIG. 6B, lid 100 may be provided with two ribs 46. In this embodiment, each rib 46 is connected to the stem 18 opposite a side surface 36. In this manner, the bending forces imparted on stem 18 will be transmitted directly from the side surfaces 36 to the ribs 46.

In accordance with the preferred embodiment of the invention, the side surfaces 36 of stem 18 are designed to sealingly engage the inner surface 26 of the side wall 24 of cup 20. Referring to FIG. 7, which is an exemplary radial cross-sectional view of a stem 18 similar to that shown in FIG. 5, the side surfaces 36 are shown formed with a radius substantially the same as the radius of the inner surface 26. In this manner, the side surfaces 36 will conform to the inner surface 26 and form a fluid tight seal therewith.

In an alternative embodiment of the stem 18, which is depicted in FIG. 7A, each side surface 36 is formed on a wing 48 which is hingedly connected to the body portion 50 of stem 18. In this manner, as stem 18 is forced against the inner surface 26 the wings 48 will bend to conform to the inner surface 26. This bending moment will maintain an additional sealing force between side surfaces 36 and inner surface 26. The wings 48 may be provided substantially the entire length of stem 18, or for only a portion thereof beginning at the bottom of stem 18. It should be noted that, in FIG. 7A wings 48 are shown extending beyond inner surface 26 for purposes of clarity only.

In another alternative embodiment of the stem 18, which is illustrated in FIG. 7B, the lid of the present invention may include a pair of seals 52 extending longitudinally along each side surface 36 preferably substantially the entire length of the stem 18. The seals 52 may be formed integrally with the stem 18 or manufactured separately and affixed to the side surfaces 36 by any suitable means, such as an appropriate adhesive. In addition, while the seals 52 may be constructed of the same material as the lid, they are preferable made of a more resilient material.

In yet another embodiment of the stem 18, which is shown in FIG. 7C, each side surface 36 is formed on a sidewall 54 extending laterally from the body portion 50 of the stem 18. This results in the side surfaces 36 having a lateral extent which is greater than in previous embodiments. Consequently, the side surfaces 36 have a greater sealing area and are thus better able to accommodate any imperfections in the inner surface 26 which could otherwise prevent an effective seal. The stem 18 of this embodiment may also comprise one or more ribs 56 to provide radial support for the sidewalls 54.

Referring now to FIG. 8, another embodiment of the lid of the present invention, indicated generally by reference number 200, is shown to comprise a stem 18 having a overlay 58 applied to each side surface 36. The overlay 58 is preferably a relatively soft elastomer material that is joined with stem 18 in the final step of a dual injection molding process. The overlay 58 allows the lid 200 to be constructed of a relatively stiff material so that the stem 18 will be maintained tightly against the side wall 24 in an interference fit without the need for ribs or a thick radial cross section. In addition, the overlay 58 provides for better sealing against inner surface 26 than a stiffer plastic material.

In order to allow the lid 200 to be constructed of a stiffer material but still be easily connected and disconnected from a cup 20, the lid 200 may also be provided with a snap ring 60 connected to the inner surface of the rim 14. The snap ring 60 is preferably constructed of a soft, flexible plastic or elastomer material, and may be made of the same material as overlay 58 and joined to lid 200 in the same step of the dual injection molding process. The snap ring 60 comprises the constriction 34 which is designed to engage the lip 32 to secure the lid 200 to the cup 20. Since constriction 34 is made of a relatively flexible material, the lid 200 may be easily connected to and removed from the cup 20. As seen more clearly in FIG. 8A, snap ring 60 also contains an upper portion or gasket 62 which is received within a corresponding recess 64 formed in the underside of base 12. Gasket 62 aides in sealing the lid 200 to the rim 28 of the cup 20 to prevent leakage.

Figure 8B:
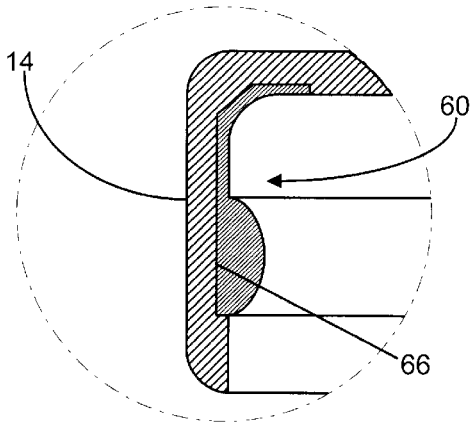
FIGS. 8B through 8E are enlarged views similar to FIG. 8A, but showing alternative embodiments of the lid of the present invention.
Figure 8C:
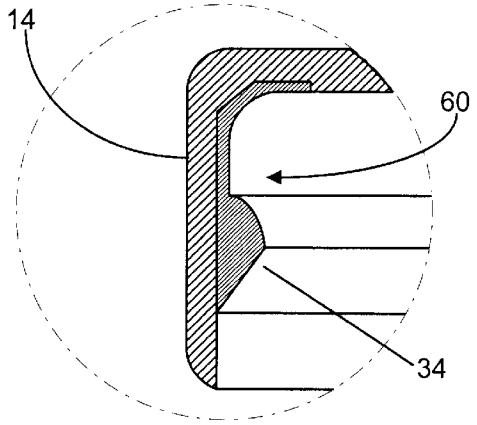
Figure 8D:
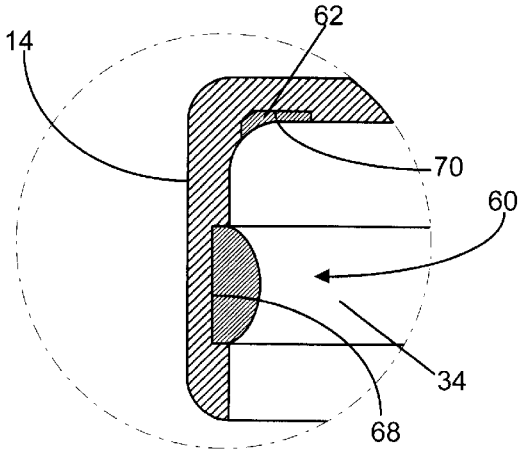
Figure 8E:
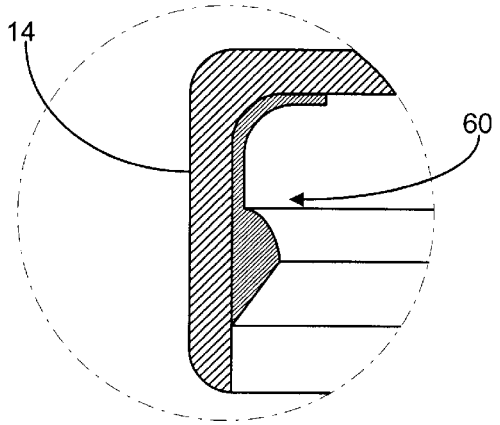

FIGS. 8B through 8E illustrate various alternative embodiments of snap ring 60. In FIG. 8B, snap ring 60 is received in a corresponding recess 66 formed in the inner surface of rim 14. In this manner, snap ring 60 is more securely affixed to rim 14. In FIG. 8C, snap ring 60 terminates below constriction 34 in order to reduce the amount of material employed. In FIG. 8D, snap ring 60 comprises only a radial constriction 34, which is received in a corresponding recess 68 formed in rim 14, and a separate gasket 62, which is received in a corresponding recess 70 formed in base 12. In this alternative, the amount of material employed for snap ring 60 is even further reduced. In FIG. 8E snap ring 60 is similar to that shown in FIG. 8C; but in this variation no portion of snap ring 60 is received in a recess formed in the lid 200. Thus, construction of the lid 200 of this embodiment is simplified.

Figure 9:
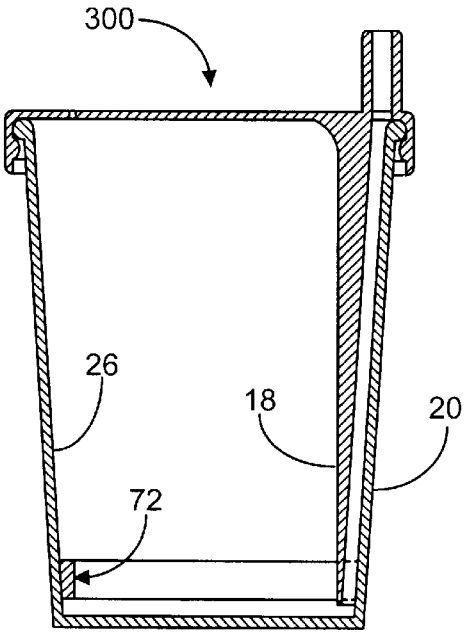
FIG. 9 is a longitudinal cross-sectional view of another embodiment of the lid of the present invention.

Referring to FIG. 9, another embodiment of the invention is shown. In this embodiment the lid, indicated generally by reference number 300, comprises an annular compression ring 72 connected to the bottom portion of stem 18. When lid 300 is inserted into cup 20, compression ring 72 will react against the inner surface 26 opposite the stem 18 to force the stem into sealing engagement with the inner surface 26 adjacent the side surfaces 36.

Figure 10:
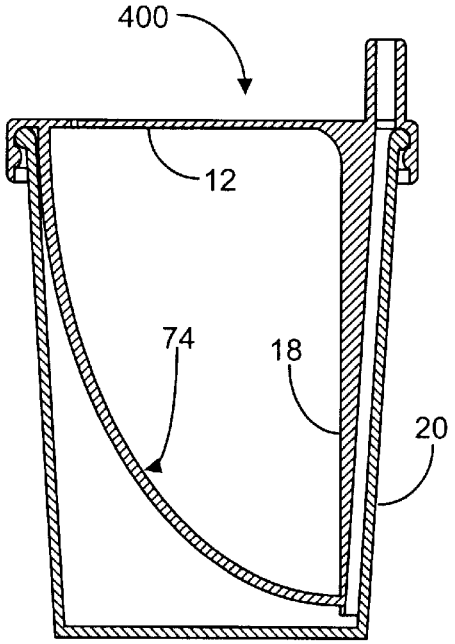
FIG. 10 is a longitudinal cross-sectional view of still another embodiment of the lid of the present invention.

Another embodiment of the invention is depicted in FIG. 10. In this embodiment the lid, indicated generally by reference number 400, comprises a compression band 74 extending between the base 12 and the bottom portion of the stem 18. In this manner, when lid 400 is secured to cup 20, compression band 74 will force the bottom portion of stem 18 into sealing engagement with the inner surface 26 of the cup 20.

Figure 11:
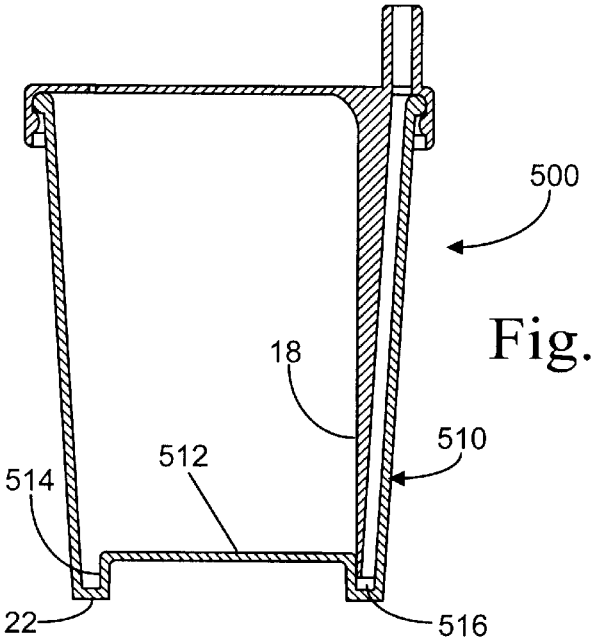
FIG. 11 is a longitudinal cross-sectional view of yet another embodiment of the lid of the present invention.

Yet another embodiment of the invention is depicted in FIG. 11. In this embodiment the lid and cup form an assembly 500. The lid of assembly 500 is similar to those of previous embodiments. However the cup, which is indicated generally by reference number 510, comprises a bottom 22 having a raised ring portion 512. The ring portion 512 comprises an outer diameter 514 which forms a trough 516 with the side wall 24 of the cup 510. The width of the trough 516 is designed to be slightly less than the width of the bottom portion of the stem 18. Thus, when the lid is secured to the cup 510, the bottom portion of the stem 18 will be received in the trough 516 and the side surfaces will be forced against the inner surface of the cup 510.

It should be recognized that, while the present invention has been described in relation to the preferred embodiments thereof, those skilled in the art may develop a wide variation of structural and operational details without departing from the principles of the invention.

What is claimed is:

1. A lid for a drinking cup having a bottom and a sidewall extending generally upwardly from the bottom, the sidewall including an upper edge and an inner surface, the lid comprising:

a base;

a rim which depends from the periphery of the base and which includes means for removably connecting the base to the cup over the upper edge;

a mouthpiece which extends generally upwardly from the base and which has a longitudinal hole formed therethrough;

an elongated stem which depends generally downwardly from the base generally opposite the mouthpiece;

the stem comprising two longitudinal side surfaces which are adapted to conform to the inner surface and a longitudinal channel formed between the side surfaces;

wherein the channel communicates with the hole in the mouthpiece and, when the lid is secured to the cup, the side surfaces engage the inner surface to form a fluid passageway through which fluid in the cup may be extracted.

2. The lid of claim 1, further comprising means for urging the side surfaces against the inner surface of the cup.

3. The lid of claim 2, wherein the urging means comprises at least one rib extending between the base and the stem.

4. The lid of claim 2, wherein the urging means comprises a compression ring which is connected to the stem and adapted to engage the inner surface of the cup at a position opposite the stem.

5. The lid of claim 2, wherein the urging means comprises a compression band extending between the base and a bottom portion of the stem.

6. The lid of claim 1, wherein the stem further comprises:

an overlay attached to each side surface;

the overlay comprising a material which is less stiff than the material of the stem;

wherein when the lid is connected to the cup, the overlay will sealingly engage the inner surface of the cup.

7. The lid of claim 6, further comprising:

a constriction attached to the inner diameter of the rim;

the constriction being adapted to removably engage a portion of the cup to secure the base over the upper edge;

the constriction comprising a material which is less stiff than the material of the rim.

8. The lid of claim 7, further comprising:

a gasket attached to the underside of the base adjacent the rim;

the gasket comprising a material which is less stiff than the material of the base;

wherein when the lid is secured to the cup, the gasket will sealingly engage the upper edge of the cup.

9. In combination with a cup having a bottom and a sidewall extending generally upwardly from the bottom, the sidewall including an upper edge and an inner surface, the improvement comprising a lid which comprises:

a base;

a rim which depends from the periphery of the base and which includes means for removably connecting the base to the cup over the upper edge;

a mouthpiece which extends generally upwardly from the base and which has a longitudinal hole formed therethrough;

an elongated stem which depends generally downwardly from the base;

the stem comprising two adjacent surfaces which are adapted to conform to the inner surface and a longitudinal channel formed between the adjacent surfaces;

wherein the channel communicates with the hole in the mouthpiece and, when the lid is secured to the cup, the adjacent surfaces engage the inner surface to form a fluid passageway through which fluid in the cup may be extracted.

10. The combination of claim 9, further comprising means attached to each adjacent surface for sealing between the surface and the inner surface of the cup.

11. The combination of claim 10, wherein the sealing means comprises a seal extending longitudinally along the surface approximately the entire length of the stem, the seal comprising a material which is less stiff than the material of the stem.

12. The combination of claim 10, wherein the sealing means comprises an overlay extending longitudinally along the surface approximately the entire length of the stem, the overlay comprising a material which is less stiff than the material of the stem.

13. The combination of claim 9, wherein the stem comprises in cross section a generally C-shaped body portion, and wherein each adjacent surface is formed on a respective wing which is hingedly connected to the body portion.

14. The combination of claim 9, wherein the stem comprises in cross section a generally C-shaped body portion, and wherein each adjacent surface is formed on a sidewall extending laterally from the body portion.

15. The combination of claim 9, further comprising means for urging the side surfaces against the inner surface of the cup.

16. The combination of claim 15, wherein the urging means comprises at least one rib extending between the base and the stem.

17. The combination of claim 15, wherein the urging means comprises a compression ring which is connected to the stem and adapted to engage the inner surface of the cup at a position opposite the stem.

18. The combination of claim 15, wherein the urging means comprises a compression band extending between the base and a bottom portion of the stem.

19. The combination of claim 15, wherein the cup comprises a trough formed between the sidewall and a raised portion of the bottom, and wherein the urging means comprises the trough.

* * * * *